US008739842B2

(12) United States Patent
Bolt et al.

(10) Patent No.: US 8,739,842 B2
(45) Date of Patent: Jun. 3, 2014

(54) METHOD FOR ADJUSTING AIR TO LIQUID RATIO IN VAPOR RECOVERY SYSTEM

(75) Inventors: David Bolt, Duncansville, PA (US); James C. Little, Avon, CT (US); Niranjan Srinivasan, Hollidaysburg, PA (US)

(73) Assignee: Veeder-Root Company, Simsbury, CT (US)

( * ) Notice: Subject to any disclaimer, the term of this patent is extended or adjusted under 35 U.S.C. 154(b) by 603 days.

(21) Appl. No.: 12/858,802

(22) Filed: Aug. 18, 2010

(65) Prior Publication Data

US 2011/0259470 A1 Oct. 27, 2011

Related U.S. Application Data

(60) Provisional application No. 61/252,822, filed on Oct. 19, 2009.

(51) Int. Cl.
*B65B 31/00* (2006.01)
*B67D 7/04* (2010.01)

(52) U.S. Cl.
CPC ..... *B67D 7/048* (2013.01); *Y10S 141/01* (2013.01); *Y10S 137/909* (2013.01)
USPC ..... 141/302; 141/59; 141/DIG. 1; 137/909; 251/65

(58) Field of Classification Search
USPC ..... 141/46, 59, 302, 290, DIG. 1; 137/909; 251/65
See application file for complete search history.

(56) References Cited

U.S. PATENT DOCUMENTS

| | | | |
|---|---|---|---|
| 3,081,788 | A | 3/1963 | Lewis |
| 4,649,970 | A | 3/1987 | Bower et al. |
| 5,327,944 | A | 7/1994 | Healy |
| 5,720,325 | A | 2/1998 | Grantham |

(Continued)

FOREIGN PATENT DOCUMENTS

| | | |
|---|---|---|
| DE | 4028571 | 2/1992 |
| EP | 0703186 | 5/1998 |

OTHER PUBLICATIONS

PCT International Search Report dated Dec. 6, 2010, regarding co-pending PCT Application No. PCT/US2010/053065 filed Oct. 18, 2010.
U.S. Appl. No. 12/906,879, filed Oct. 18, 2010.

(Continued)

*Primary Examiner* — Timothy L Maust
*Assistant Examiner* — Timothy P Kelly
(74) *Attorney, Agent, or Firm* — Nelson Mullins Riley & Scarborough, LLP

(57) ABSTRACT

An air to liquid regulator valve for use with a vapor recovery system that recovers vapors expelled from a vehicle receiving fuel through a fuel supply passage and returns the vapors to an underground storage tank through a vapor return passage in a service station environment. The regulator valve includes a housing defining a fuel flow path in fluid communication with the fuel supply passage and a vapor return path in fluid communication with the vapor return passage, a vapor return orifice defined by the housing and disposed between a first portion and a second portion of the vapor return path, and a vapor flow bypass in fluid communication with the first portion and the second portion of the vapor return path such that the flow of vapors through both the vapor flow bypass and the vapor return orifice is possible.

16 Claims, 10 Drawing Sheets

(56) References Cited

U.S. PATENT DOCUMENTS

| | | | | |
|---|---|---|---|---|
| 5,860,457 | A | 1/1999 | Andersson | |
| 6,332,483 | B1 | 12/2001 | Healy | |
| 6,532,999 | B2 | 3/2003 | Pope et al. | |
| 6,533,254 | B1 | 3/2003 | Grifka et al. | |
| 6,866,299 | B2 | 3/2005 | Coates | |
| 8,167,003 | B1 * | 5/2012 | Clever et al. | 141/5 |
| 8,371,341 | B2 * | 2/2013 | Gray | 141/59 |
| 8,539,991 | B1 * | 9/2013 | Carmack et al. | 141/206 |
| 2007/0267088 | A1 | 11/2007 | Hughes | |

OTHER PUBLICATIONS

Office Action dated Mar. 20, 2013 for co-pending Chinese patent application 201080056960.X.

* cited by examiner

METHOD FOR ADJUSTING AIR TO LIQUID RATIO IN VAPOR RECOVERY SYSTEM

CLAIM OF PRIORITY

This application claims priority to U.S. Provisional Patent Application Ser. No. 61/252,822, filed Oct. 19, 2009, the entire disclosure of which is incorporated by reference herein.

FIELD OF THE INVENTION

The present invention generally relates to the recovery of fuel vapors in connection with a liquid fuel dispensing facility. More particularly, the present invention relates to controlling the volume of fuel vapor recovered to ensure that the volume is in appropriate proportion to the volume of liquid fuel being dispensed.

BACKGROUND OF THE INVENTION

Liquid fuel dispensing facilities (i.e. gasoline stations) often suffer from a loss of fuel to the atmosphere due to inadequate vapor collection during fuel dispensing activities, excess liquid fuel evaporation in the containment tank system, and inadequate reclamation of the vapors during tanker truck deliveries. Lost vapor is an air pollution problem which is monitored and regulated by both the federal and state governments. Attempts to minimize losses to the atmosphere have been effected by various vapor recovery methods. Such methods include: "Stage-I vapor recovery" where vapors are returned from the underground fuel storage tank to the delivery truck; "Stage-II vapor recovery" where vapors are returned from a refueled vehicle tank to the underground storage tank; vapor processing where the fuel/air vapor mix from the underground storage tank is received and the vapor is liquefied and returned as liquid fuel to the underground storage tank; burning excess vapor off and venting the less polluting combustion products to the atmosphere; and other fuel/air mix separation methods.

When working properly, Stage-II vapor recovery results in equal exchanges of air or vapor (A) and liquid (L) between the main fuel storage tank and the consumer's gas tank. Ideally, Stage-II vapor recovery produces an A/L ratio very close to 1.0. In other words, returned vapor replaces an equal amount of liquid in the main fuel storage tank during refueling transactions. When the A/L ratio is close to 1.0, refueling vapors are collected, the ingress of fresh air into the storage tank is minimized, and the accumulation of an excess positive or negative pressure in the main fuel storage tank is prevented. This minimizes losses at the fuel dispensing nozzle and evaporation and leakage of excess vapors from the storage tank. Measurement of the A/L ratio thus provides an indication of proper Stage-II vapor collection operation. A low A/L ratio means that the proper amount of fuel vapor is not being recovered for the amount of fuel that has been dispensed.

The present invention recognizes and addresses considerations of prior art constructions and methods.

SUMMARY OF THE INVENTION

One embodiment of the present invention provides an air to liquid regulator valve for use with a vapor recovery system that recovers vapors expelled from a vehicle receiving fuel through a fuel supply passage and returns the vapors to an underground storage tank through a vapor return passage in a service station environment. The regulator valve includes a housing defining a fuel flow path in fluid communication with the fuel supply passage and a vapor return path in fluid communication with the vapor return passage, a vapor return orifice defined by the housing and disposed between a first portion and a second portion of the vapor return path, and a vapor flow bypass in fluid communication with the first portion and the second portion of the vapor return path such that the flow of vapors through both the vapor flow bypass and the vapor return orifice is possible.

Another embodiment of the present invention provides a vapor recovery system that recovers vapors expelled from a vehicle during refueling at a fuel dispensing point and returns the vapors to an underground storage tank in a service station environment, the system including an air to liquid regulator valve associated with the fuel dispensing point. The regulator valve includes a housing defining vapor return path, a vapor return orifice defined by the housing and disposed between a first portion and a second portion of the vapor return path, and a vapor flow bypass in fluid communication with the first portion and the second portion of the vapor return path such that the flow of vapors through both the vapor flow bypass and the vapor return orifice is possible. The system also includes a vapor pump that is in fluid communication with the underground storage tank, and a vapor flow passage that is in fluid communication with the vapor flow path of the air to liquid regulator valve and the vapor pump.

Yet another embodiment of the present invention provides an air to liquid regulator valve for use with a vapor recovery system that recovers vapors expelled from a vehicle receiving fuel through a fuel supply passage and returns the vapors to an underground storage tank through a vapor return passage in a service station environment. The regulator valve includes a housing defining a fuel flow path in fluid communication with the fuel supply passage and a vapor return path in fluid communication with the vapor return passage, a vapor return orifice defined by the housing and disposed between a first portion and a second portion of the vapor return path, and a vapor piston including a metering element, wherein the metering element is insertable into the vapor return orifice to regulate the flow of vapors therethrough, and the metering element is configured to prevent the flow of vapors through the vapor return orifice when the metering element is fully seated in the vapor return orifice. A vapor flow bypass is in fluid communication with the first portion and the second portion of the vapor return path such that the flow of vapors through the vapor flow bypass is possible when the metering nose prevents the flow of vapors through the vapor return orifice. A first flow adjustment mechanism selectively adjusts the vapor flow bypass such that an amount of vapor that is allowed to bypass the vapor return orifice during a fueling operation is adjustable.

Other objects, features and aspects for the present invention are discussed in greater detail below. The accompanying drawings are incorporated in and constitute a part of this specification, and illustrate one or more embodiments of the invention. These drawings, together with the description, serve to explain the principles of the invention.

BRIEF DESCRIPTION OF THE DRAWINGS

A full and enabling disclosure of the present invention, including the best mode thereof, to one of ordinary skill in the art, is set forth more particularly in the remainder of this specification, including reference to the accompanying drawings, in which.

Figure 1:
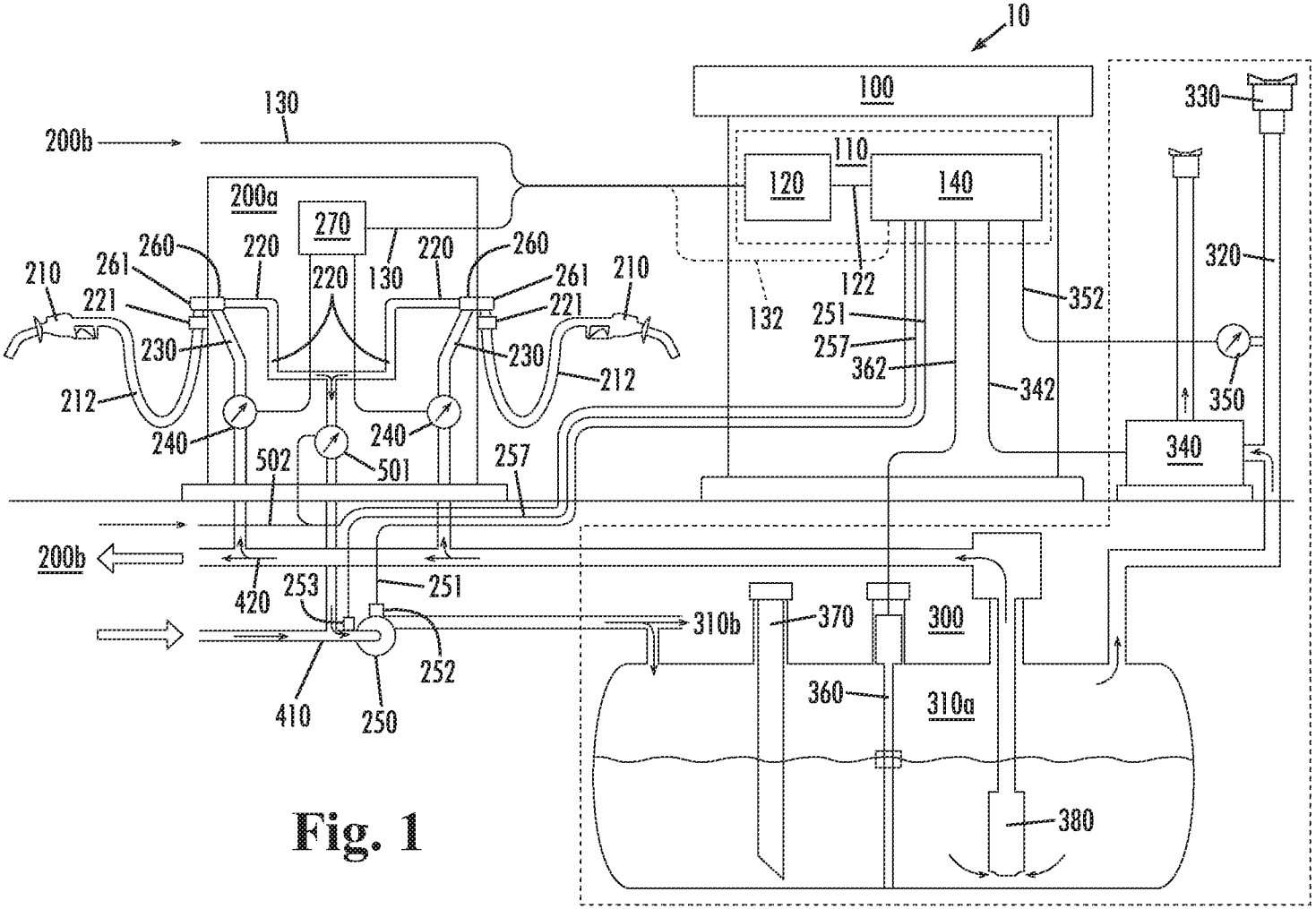
FIG. 1 is a diagrammatic representation of a liquid fuel dispensing facility including a fuel vapor recovery system in accordance with a first embodiment of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

A first embodiment of the present invention is described in connection with FIG. 1, which shows a vapor recovery system for use in a liquid fuel dispensing facility 10, in accordance with the present invention. As shown, the fuel dispensing facility 10 includes a station house 100, one or more fuel dispenser units 200*a* and 200*b* (fuel dispenser unit 200*b* is not shown), a main fuel storage system 300, means for connecting the fuel dispenser units 200*a* and 200*b* to the main fuel storage system 300, and one or more vapor (or air) flow sensors (AFS's) 501. The fuel dispenser units 200*a* and 200*b* may be the ENCORE® sold by Gilbarco, inc. of Greensboro, N.C., or other fuel dispenser, such as that disclosed in U.S. Pat. No. 4,978,029, which is hereby incorporated by reference in its entirety.

As illustrated in FIG. 1, the station house 100 includes a central electronic control system 110 that includes a dispenser controller 120 (also known as a site controller or point-of-sale system), dispenser current loop interface wiring 130 connecting the dispenser controller 120 with the fuel dispenser unit(s) 200*a* and 200*b*, and a data acquisition system 140. The dispenser controller 120 controls the fuel dispenser units 200*a* and 200*b* and processes transaction information received from the dispensers 200 over the current loop 130. The dispenser controller 120 is in electrical communication with the data acquisition system 140, such as by a first wiring bus 122. The interface wiring 130 may be electrically connected to the data acquisition system 140 by a second wiring bus 132. The dispenser controller 120 may be the Gilbarco G-Site® or Passport® point-of-sale system.

The data acquisition system 140 preferably includes standard computer storage and central processing capabilities, keyboard input device(s), and audio and visual output interfaces among other conventional features. Entities such as the California Air Resources Board (CARB) have produced requirements for Enhanced Vapor Recovery (EVR) equipment. These include stringent vapor recovery system monitoring requirements to determine continuously whether or not the systems are working properly. In locations subject to these enhanced requirements, the data acquisition system 140 may also function as an in-station diagnostic monitor. For example, where required, the data acquisition system 140 may be the Veeder-Root Company TLS-350™ tank monitor. Both the dispenser controller 120 and the data acquisition system 140 may be further communicatively coupled to an off-site or remote system (not shown) for communicating information and receiving instructions remotely, in which case both systems may communicate with the remote system over telephone lines or other network lines, including the Internet.

Figure 2:
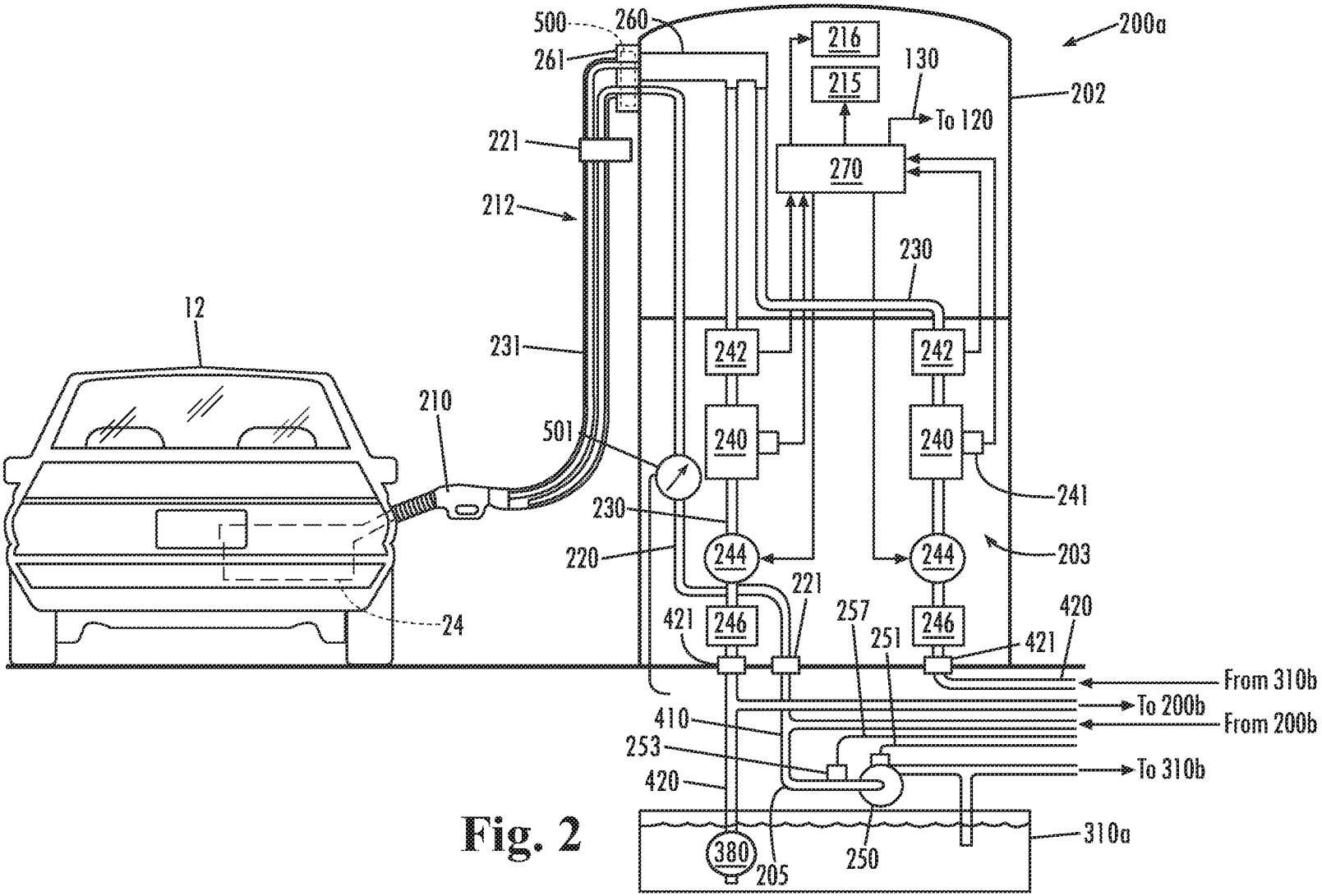
FIG. 2 is a diagrammatic representation of the fuel dispenser as shown in FIG. 1.
Figure 3:
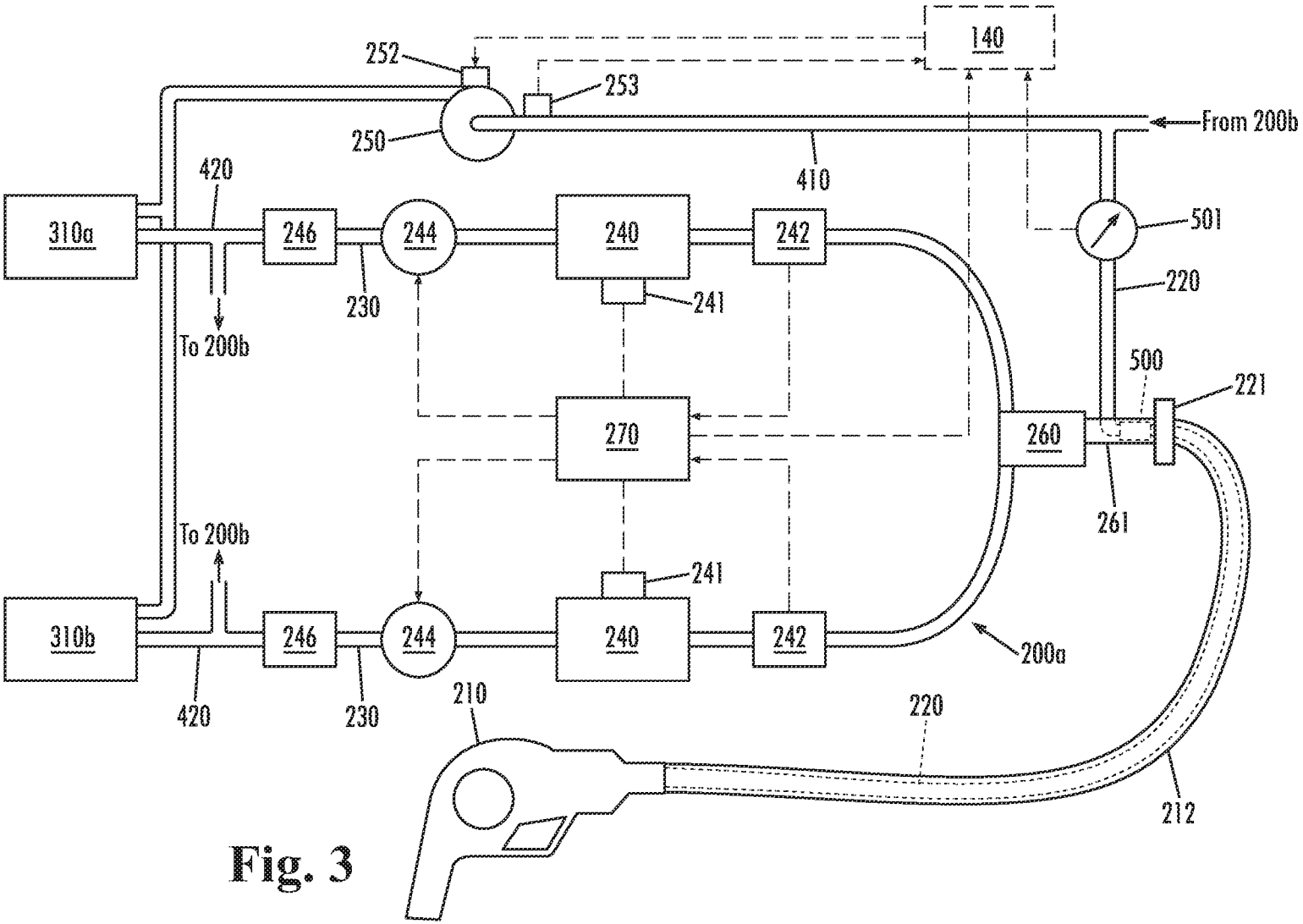
FIG. 3 is a schematic diagram illustrating certain operational characteristics of the fuel dispenser unit as shown in FIG. 2.

Referring additionally to FIGS. 2 and 3, the fuel dispenser units 200*a* and 200*b* may be provided in the form of conventional "gas pumps." Each of the fuel dispenser units 200*a* and 200*b* may include one or more fuel dispensing points typically defined by nozzles 210. In the preferred embodiment shown, the fuel nozzles 210 are suitable vapor recovery nozzles used in combination with a mechanical air to liquid vapor regulator valve 500 (hereafter A/L regulator valve), such as that shown in FIGS. 7, 8A and 8B. The operation of the A/L regulator valve 500 is discussed in greater detail below.

Each fuel dispensing point of the fuel dispenser units 200*a* and 200*b* includes a blend manifold 260, a coaxial vapor/liquid splitter 261, a vapor return passage 220, a fuel supply passage 230 and the mechanical A/L regulator valve 500. As shown, the mechanical A/L regulator valve 500 is preferably disposed adjacent the coaxial vapor/liquid splitter 261. The vapor return passages 220 may be joined together before connecting with a common vapor return pipe 410 (FIG. 1).

The fuel dispenser units 200*a* and 200*b* also include liquid fuel dispensing meters 240. The liquid fuel dispensing meters 240 provide dispensed liquid fuel quantity information to the dispenser controller 120 via a liquid fuel dispensing meter interface 270, or control system, and interface wiring 130. The control system 270 may be a microcontroller, a microprocessor, or other electronics with associated memory and software programs running thereon. The control system 270 typically controls aspects of the fuel dispenser units 200*a* and 200*b*, such as a gallons (or liters) display 215, a price display 216, receipt of payment transactions, and the like, based on fuel flow information received from the liquid fuel dispensing meters 240.

The main fuel storage system 300 includes one or more main fuel storage tanks 310*a* and 310*b*. The fuel storage tanks 310*a* and 310*b* are typically provided underground, however, underground placement of the tank is not required for application of the invention. As best seen in FIG. 1, each fuel storage tank 310*a* and 310*b* is connected to the atmosphere by a vent pipe 320. The vent pipe 320 terminates in a pressure relief valve 330. A vapor processor 340 may be connected to the vent pipe 320 intermediate of the fuel storage tanks 310*a* and 310*b* and the pressure relief valve 330. Note, a vapor processor is not typically required in locations that are not subject to enhanced monitoring requirements. In this case, a pressure sensor 350 is operatively connected to the vent pipe 320. The fuel storage tanks 310*a* and 310*b* may also include an Automatic Tank Gauging System (ATGS) 360 used to provide information regarding the fuel level in the storage tanks. The vapor processor 340, the pressure sensor 350, and the automatic tank gauging system 360 are electrically connected to the data acquisition system 140 by third, fourth, and fifth wiring busses 342, 352, and 362, respectively. The fuel storage tanks 310*a* and 310*b* also include a fill pipe and fill tube 370 to provide a means to fill the tanks with fuel and a submersible pump 380 to supply the dispensers 200*a* and 200*b* with fuel from the storage tanks 310*a* and 310*b*.

The means for connecting the fuel dispenser units 200*a* and 200*b* and the main fuel storage system 300 include a vapor return pipeline 410 and one or more fuel supply pipelines 420. The vapor return pipeline 410 and the fuel supply pipelines 420 are connected to the vapor return passages 220 and fuel supply passages 230, respectively, associated with multiple fuel dispensing points 210. Fuel supply pipelines 420 may be double-walled pipes having secondary containment, as is well known. An exemplary underground fuel delivery system is illustrated in U.S. Pat. No. 6,435,204, which is hereby incorporated by reference in its entirety.

In the embodiment illustrated in FIG. 1, a variable speed vapor pump 250 driven by a motor 252 is coupled to the plurality of vapor return passages 220 by way of the common vapor return pipeline 410 to assist in the recovery of fuel vapor. In the preferred embodiment shown, variable speed vapor pump 250 may be the Healy VP1200®. An example of this system is found in U.S. Pat. No. 5,040,577, incorporated herein by reference in its entirety. The data acquisition system 140 receives information regarding the pressure in vapor return pipeline 410 from a pressure sensor 253 that is disposed on the inlet side of vapor pump 250 and electrically connected to the data acquisition system 140 by interface wire 257.

As shown in FIG. 1, an AFS 501 is deployed in a common branch of the vapor return passages 220 to measure the vapor flows of various groupings of fuel dispensing points 210, down to a minimum of only two dispensing point vapor flows. The latter example is realized by installing one AFS 501 in each of the fuel dispenser units 200*a* and 200*b*, which typically contains two dispensing points 210 (one dispensing point per dispenser side), as shown, or up to six dispensing points in MultiProduct Dispensers (MPD's) (3 per side). The vapor flows piped through the vapor return passage 220 are combined to pass through the single AFS 501 in the dispenser housing. However, alternate embodiments can include an AFS 501 that is dedicated to each individual fuel dispensing point 210 such that each AFS 501 measures the vapor flow from an individual fuel dispensing point 210. Note, air flow sensors are not typically required in locations that are not subject to enhanced monitoring requirements.

Referring additionally to FIG. 3, the internal fuel flow components of one example of the present invention are illustrated. As previously noted, fuel travels from one or more of underground fuel storage tanks 310*a* and 310*b* by way of fuel supply pipelines 420 associated with their respective underground storage tank. The fuel supply pipelines 420 pass into the housing 202 of the fuel dispenser unit 200*a* through shear valves 421 (FIG. 2). The shear valves 421 are designed to cut off fuel flowing through their respective fuel supply pipelines 420 if the fuel dispenser unit 200 is impacted, as is commonly known in the industry. An exemplary embodiment of a shear valve is disclosed in U.S. Pat. No. 6,575,206, which is hereby incorporated by reference in its entirety. Similarly, vapor return passage 220 passes out of the fuel dispenser unit 200*a* through a shear valve 221 (FIG. 2).

As shown in FIG. 3, the fuel flow paths from the underground fuel storage tanks 310*a* and 310*b* to the fuel nozzle 210 each include a fuel filter 246 and a proportional valve 244 positioned along the fuel line 230 upstream of the liquid fuel dispensing meter 240. Alternatively, the proportional valve 244 may be positioned downstream of the liquid fuel dispensing meter 240. The liquid fuel dispensing meter 240 and the proportional valve 244 are positioned in a fuel handling compartment 203 of the housing 202. The fuel handling compartment 203 is isolated from an electronics compartment located above a vapor barrier 205. The fuel handling compartment 203 is isolated from sparks or other events that may cause combustion of fuel vapors, as is well understood and as is described in U.S. Pat. No. 5,717,564, which is hereby incorporated by reference in its entirety.

The liquid fuel dispensing meter 240 communicates through the vapor barrier 205 via a pulser signal line from pulser 241 to the control system 270. The control system 270 regulates the proportional valve 244, via a valve communication line, to open and close during fueling operations. The proportional valve 244 may be a proportional solenoid controlled valve, such as described in U.S. Pat. No. 5,954,080, which is incorporated herein by reference in its entirety. As the control system 270 directs the proportional valve 244 to open to allow increased fuel flow, the fuel enters the proportional valve 244 and exists into the liquid fuel dispenser meter 240. The flow rate of the displaced volume of the fuel is measured by the liquid fuel dispenser meter 240 which communicates the flow rate of the displaced volume of fuel to the control system 270 via the pulser signal line. A pulse signal is generated on the pulser signal line in the example illustrated, such as by a Hall-effect sensor as described in U.S. Pat. No. 7,028,561, which is incorporated herein by reference in its entirety. In this manner, the control system 270 uses the pulser signal from the pulser signal line to determine the flow rate of fuel flowing through the fuel dispenser unit 200*a* and being delivered to the vehicle 12. The control system 270 updates the total gallons dispensed on the gallons display 215 via a gallons display communication line, as well as the cost of fuel dispensed on the price display 216 via a price display communication line.

As fuel leaves the liquid fuel dispensing meter 240, the fuel enters a flow switch 242. The flow switch 242 generates a flow switch communication signal via a flow switch signal line to the control system 270 to communicate when fuel is flowing through liquid fuel dispensing meter 240. The flow switch communication signal indicates to the control system 270 that fuel is actually flowing in the fuel delivery path and that subsequent pulser signals from liquid fuel dispensing meter 240 are due to actual fuel flow.

After the fuel enters the flow switch 242, it exits through the fuel supply passage 230 to be delivered to the blend manifold 260. The blend manifold 260 receives fuels of varying octane values from the various underground fuel storage tanks 310*a* and 310*b* and ensures that fuel of the octane level selected by the consumer is delivered to the consumer's vehicle 12. After flowing through the blend manifold 260, the fuel passes through the fuel hose 212 and fuel nozzle 210 for delivery into the fuel tank 24 of the vehicle 12. Flexible fuel hose 212 includes a product delivery line 231 and the vapor return passage 220. Both lines 231 and 220 are fluidly connected to the underground fuel storage tanks 310*a* and 310*b* through the fuel dispenser unit 200*a*, as previously discussed.

The vapor return passage 220 is separated from the product delivery line 231 by the coaxial vapor/liquid splitter 261.

During delivery of fuel into the vehicle's fuel tank 24, the incoming fuel displaces air in the fuel tank 24 containing fuel vapors. Vapor is recovered from the fuel tank 24 of the vehicle 12 through the vapor return passage 220 with the assistance of the vapor pump 250. As previously noted, the vapor pump 250 of the present embodiment is a variable speed pump. As fuel is dispensed from the fuel nozzle 210 into the fuel tank 24 of the vehicle 12, the flowing fuel causes the mechanical A/L regulator valve 500 to open, thereby opening the vapor return passage 220 to the fuel tank 24.

Figure 7:
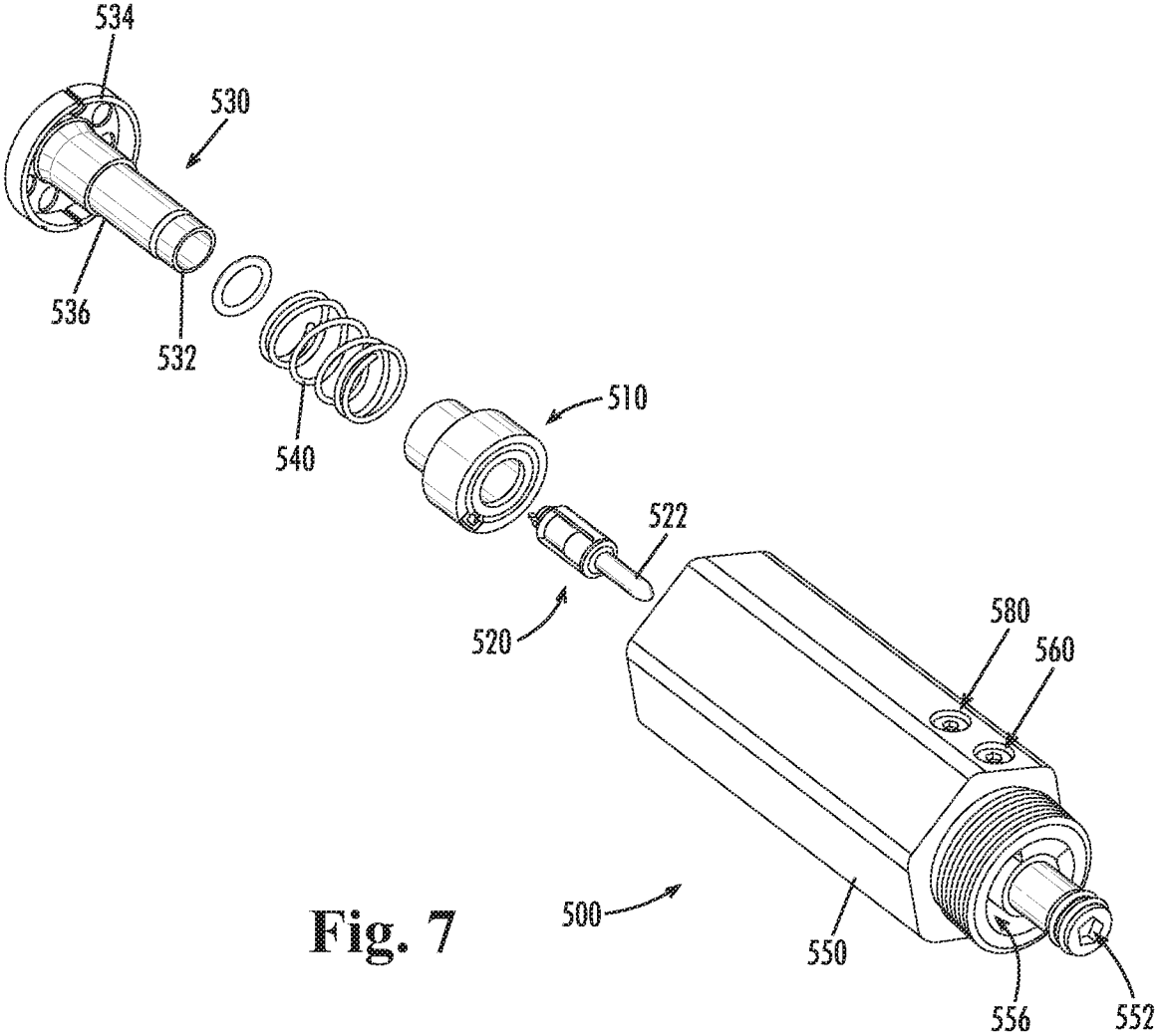
FIG. 7 is a partially exploded perspective view of an air to liquid vapor regulator valve, as may be used in the fuel vapor recovery system as shown in FIGS. 1, 4 and 6.
Figure 8A:
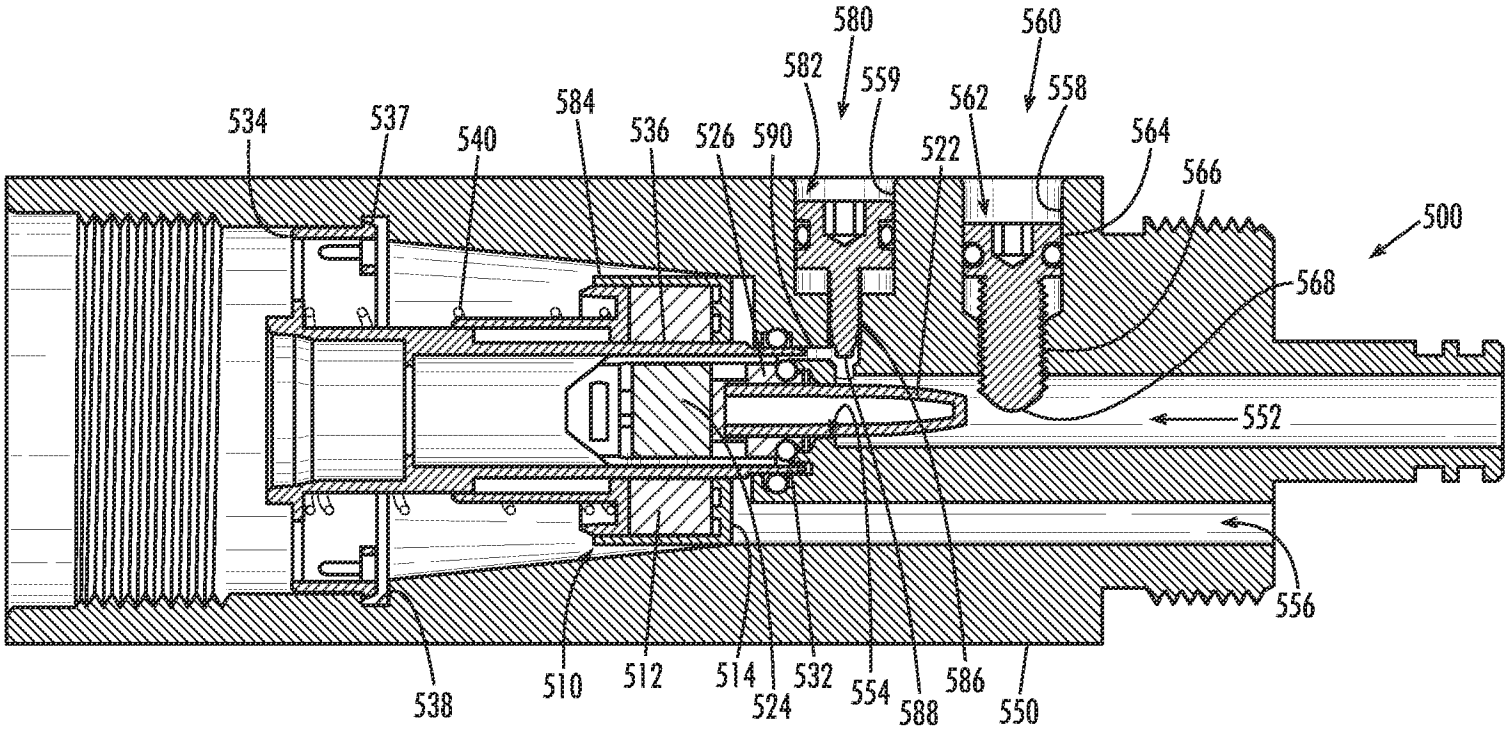
FIGS. 8A and 8B are cross-sectional views of the air to liquid vapor regulator valve as shown in FIG. 6.
Figure 8B:
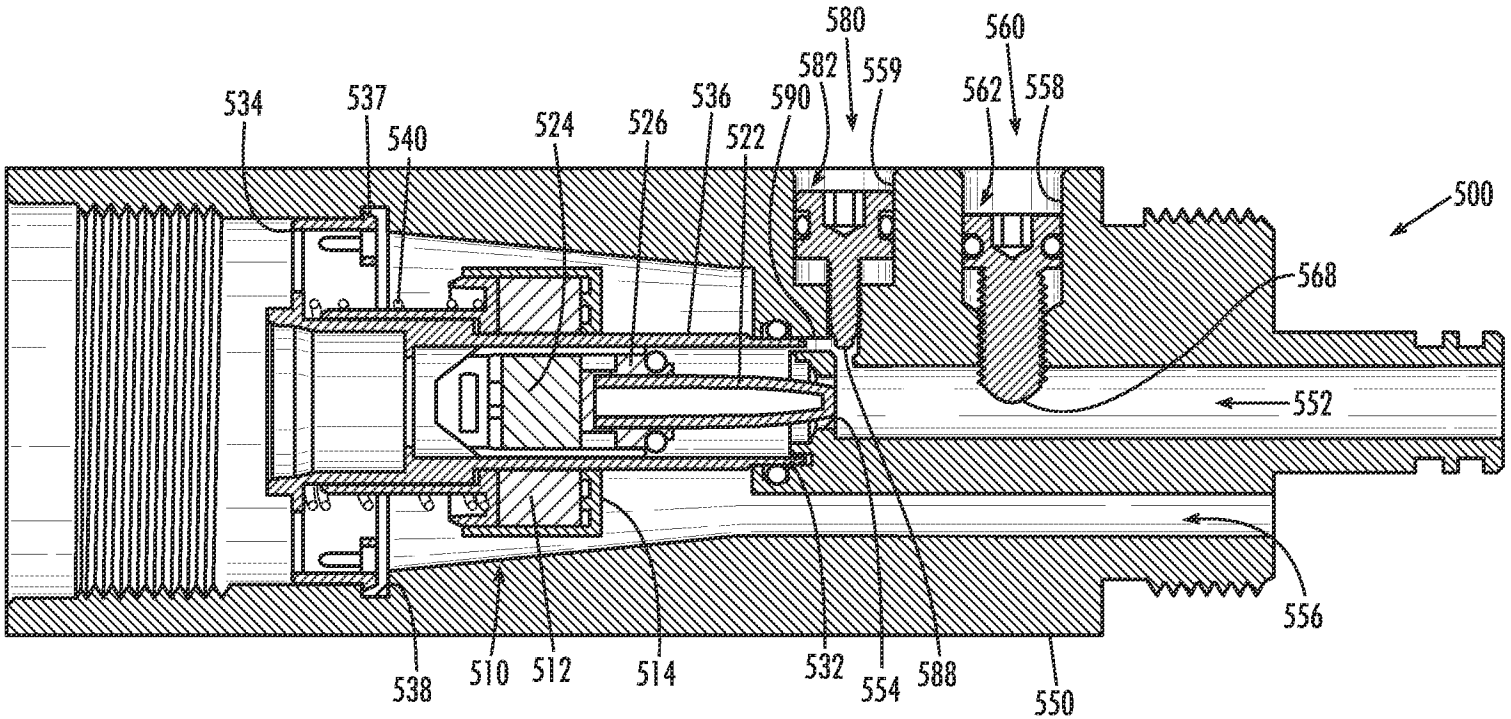

More specifically, referring additionally to FIGS. 7, 8A and 8B, the A/L regulator valve 500 includes a liquid piston 510, a vapor piston 520, a vapor tube 530, and a spring 540, all of which are received within housing 550. Additionally, the A/L regulator valve 500 includes a high flow adjustment mechanism 560 and a low flow adjusting mechanism 580 for adjusting the amount of recovered vapor for a given amount of fuel dispensed, as discussed in greater detail below. As best seen in FIGS. 8A and 8B, housing 550 defines a vapor flow path 552 along its longitudinal center axis that includes a vapor return orifice 554 at its terminal end. Additionally, the housing 550 defines a fuel flow path 556 that is substantially cylindrical in shape and concentric about the vapor flow path 552. The housing 550 is configured such that the vapor flow path 552 is in fluid communication with the vapor return passage 220 and the fuel flow path 556 is in fluid communication with the product delivery line 231 of flexible fuel hose 212 (FIG. 2).

The vapor tube 530 includes a first end 532, a second end 534 and a cylindrical portion 536 extending therebetween. The first end 532 of the vapor tube 530 is received concentrically within the housing 550 about the vapor flow path 552 and the vapor return orifice 554. In this embodiment, the vapor tube 530 is retained within the housing 550 by an annular lip 537 formed about the second end 534 of the vapor tube 530 that interacts with an annular groove 538 formed about the inner surface of the housing 550. The cylindrical portion 536 of the vapor tube 530 thus forms a portion of the vapor return path 552.

The vapor piston 520 includes a metering element, or nose 522, and a magnet 524 that are disposed on a shuttle body 526. The vapor piston 520 is slidably received within the cylindrical portion 536 of vapor tube 530 such that back and forth motion of the vapor piston 520 within the vapor tube 530 causes the metering nose 522 to regulate the flow of fuel vapor through the vapor return orifice 554.

The liquid piston 510 includes a magnet 512 and is slidably mounted along the outer surface of the vapor tube 530. The spring 540 is also mounted about the outer surface of the vapor tube 520 and is arranged such that the liquid piston 510 is urged into the closed position (FIG. 8A). Similarly, interaction of the magnet 512 of the liquid piston 510 with the magnet 524 of the vapor piston 520 ensures that when the liquid piston 510 is in the closed position, the metering nose 522 of the vapor piston 520 is fully seated in the vapor return orifice 554.

The high flow adjustment mechanism 560 includes a high flow adjustment screw 562 that is rotationally received in a first bore 558 defined by the housing 550. The high flow adjustment screw 562 includes a head 564 that is received in a smooth portion of the first bore 558 and a threaded shank 566 that is received in a correspondingly threaded portion of the first bore 558. As such, rotation of the high flow adjustment screw 562 causes the high flow adjustment screw 562 to move along the longitudinal axis of the first bore 558, thereby causing a distal end 568 of the treaded shank 566 to either project farther into, or be withdrawn from, the vapor return path 552. In this manner, the high flow adjustment screw 562 can be used to adjust the amount of vapor recovered for a given amount of fuel that is dispensed at a given rate, as discussed in greater detail below.

The low flow adjustment mechanism 580 includes a low flow adjustment screw 582 that is rotationally received in a second bore 559 defined by the housing 550, and a vapor flow bypass 590 that is in fluid communication with both the portion of the vapor flow path 552 both upstream and downstream of vapor return orifice 554. The low flow adjustment screw 582 includes a head 584 that is received in a smooth portion of the second bore 559 and a threaded shank 586 that is received in a correspondingly threaded portion of the second bore 559. As such, rotation of the low flow adjustment screw 582 within the second bore 559 causes the low flow adjustment screw 582 to move along the longitudinal axis of the second bore 559, thereby causing a distal end 588 of the threaded shank 586 to either project farther into, or be withdrawn from, the vapor flow bypass 590. In this manner, the low flow adjustment screw 582 can be used to adjust the amount of vapor that is allowed to bypass the vapor return orifice 554 during fueling operations. Note, the distal end 588 of the low flow adjustment screw 582 can be fully seated within a portion of the vapor flow bypass 590 such that the flow of vapor through the vapor flow bypass 590 is prevented.

In use, a user activates the fuel nozzle 210 causing pressurized fuel to enter the fuel flow path 556 of the A/L regulator valve 500, as discussed above. As best seen in FIG. 7A, the pressurized fuel acts against the surface area of a first end 514 of the liquid piston 510, in opposition to the biasing force of the spring 540. Eventually, the force exerted by the fuel causes the liquid piston 510 to slide along the outer surface of the cylindrical portion 536 of the vapor tube 530 against the biasing force of the spring 540, thereby opening the fuel flow path 556 and allowing fuel to flow into the vehicle's fuel tank 24. As the liquid piston 510 slides along the vapor tube 530, the vapor piston 520 similarly slides along the inner surface of the cylindrical portion 536 of the vapor tube 530 due to interaction of the magnet 524 of the vapor piston 520 with the magnet 512 of the liquid piston 510. As such, the metering nose 522 of the vapor piston 520 is withdrawn from the vapor return orifice 554 and the vapor flow path 552 is now open to the interior volume of the vehicle's fuel tank 24, as shown in FIG. 7B.

The vacuum maintained by the vapor pump 250 causes the vapor laden air that is displaced by the ingress of fuel into the fuel tank 24 to be drawn through the A/L regulator valve 500 into the vapor return passage 220. As noted above, as the rate at which fuel is dispensed increases, the vapor piston of the A/L regulator valve 500 opens further and more air is drawn into the vapor return passage 220 and associated vapor return pipeline 410.

Testing reveals that the disclosed system functions as desired when a vacuum level as low as 80 mBar is maintained on the downstream side of the A/L regulator valves 500. However, it is possible for small amounts of fuel to be drawn into the vapor return passages 220 through the associated nozzles 210 during vapor recovery. This fuel tends to collect in the lowest portion of the associated vapor return passage 220, thereby effectively blocking the vapor return passage 220 and preventing further vapor recovery if the fuel is not cleared. Although proper vapor recovery is achieved through clear vapor return passages 220 when an 80 mBar vacuum is maintained, an 80 mBar vacuum is typically not great enough to ensure that any ingested fuel is further drawn through the vapor pump 250 so that the vapor return passages 220 remain clear and the recovery of vapor is continuous. As such, preferably, a vacuum of about 200 mBar may be maintained on the downstream side of the A/L regulator valves 500 in the present embodiment. Note, higher vacuum levels can also be used as long as they are adequate for maintaining the vapor return passages 220 in an unobstructed condition.

Figure 9A:
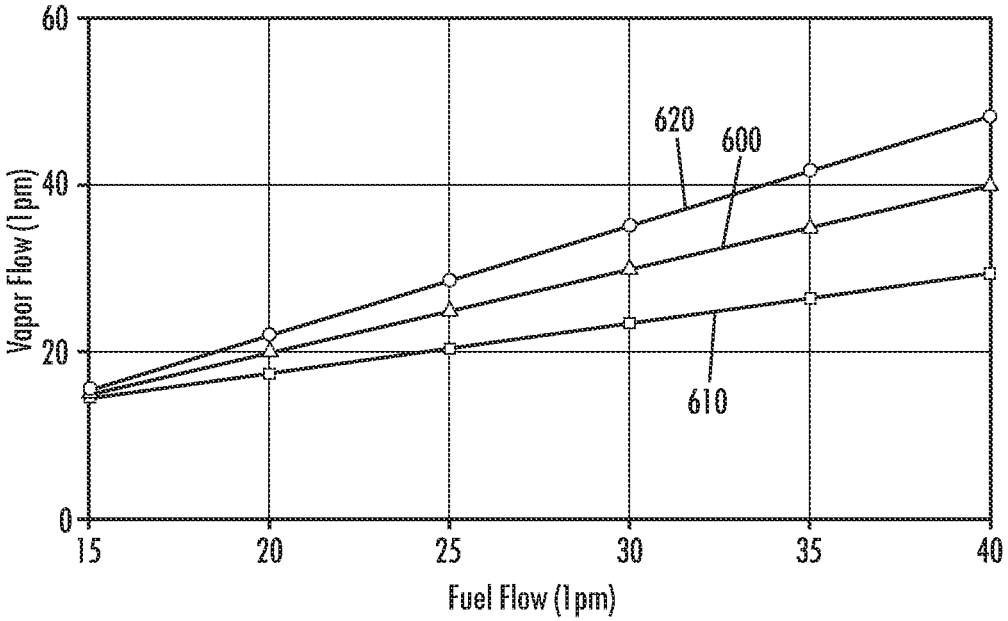
FIGS. 9A and 9B are graphs illustrating the operation of flow adjustment mechanisms in the valves of FIGS. 7, 8A and 8B.
Figure 9B:
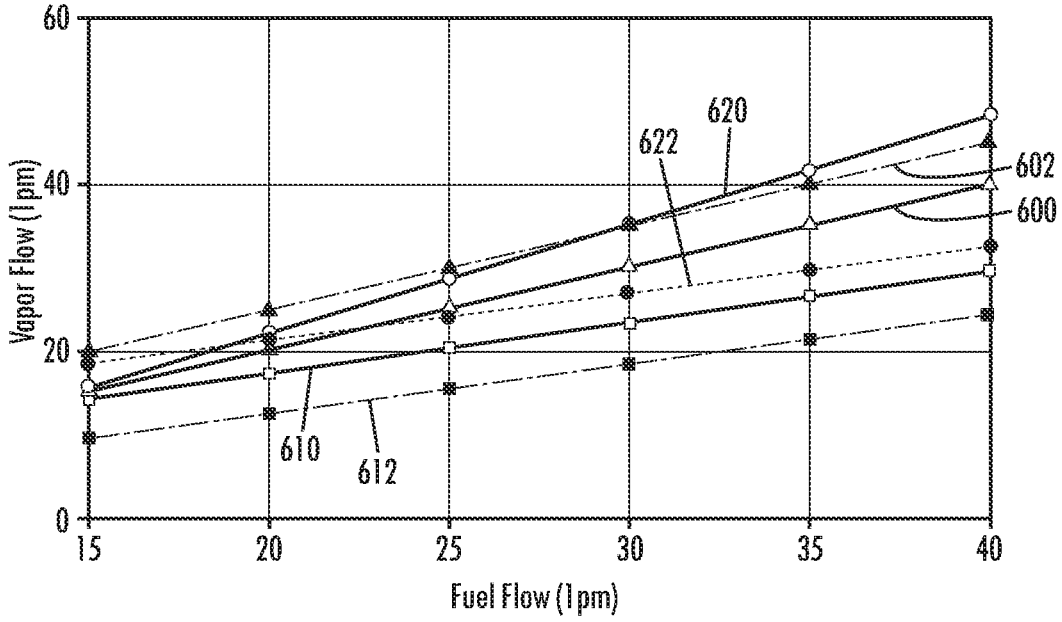

FIGS. 9A and 9B are graphical representations of how the high flow adjustment mechanism 560 and the low flow adjustment mechanism 580 can be used, either alone or in combination, to adjust the amount of vapor that is recovered for a given amount of fuel that is dispensed, thereby adjusting the A/L ratio for the related A/L regulator valve 500. Referring first to FIG. 9A, the use of the high flow adjustment mechanism 560 is discussed. For the exemplary embodiment shown, graph line 600 shows an initial setting for the high flow adjustment mechanism 560 and the low flow adjustment mechanism 580 in which the desired A/L ratio of 1:1 is achieved when fuel is being dispensed at the rate of 40 liters per minute. FIGS. 8A and 8B show a possible configuration of the A/L regulator valve 500 to achieve this A/L ratio in which the high flow adjustment screw 562 extends partially into the vapor flow path 552 and the low flow adjustment screw 582 extends partially into the vapor flow bypass 590, thereby partially restricting vapor flow. The desired initial setting for the A/L regulator valve 500, an A/L ratio of 1:1, is achieved by first providing a "rough" adjustment to the A/L ratio with the high flow adjustment mechanism 560, and then fine tuning the setting of the A/L regulator valve 500 with the low flow adjustment mechanism 580.

In the present example, graph line 600 reveals that for the desired initial setting, the A/L ratio of 1:1 is maintained across a substantial portion of the operating range of the associated fuel dispensing point 210 (FIG. 2). Note, however, that it may be necessary to adjust the A/L ratio at which a fuel dispensing point operates. One method of achieving varying A/L ratios for the A/L regulator valve 500 is reflected in graph lines 610 and 620 of FIG. 9A. Graph line 610 reflects the results of extending the high flow adjustment screw 562 farther into the vapor flow path 552 than in its initial setting, thereby further restricting the flow of vapor through the vapor flow path 552. The reduced slope of graph line 610, when compared to the slope of graph line 600, reflects the fact that less vapor is recovered for a given amount of fuel dispensed when compared to the initial setting of the high flow adjustment screw 562, at which the A/L ratio of 1:1 was achieved.

Similarly, the amount of vapor that is recovered for a given amount of fuel that is dispensed can be increased by withdrawing the high flow adjustment screw 562 farther from the vapor flow path 552 than in its initial setting, thereby reducing the restriction to the flow of vapor through the vapor flow path 552. The increased slope of graph line 620, when compared to the slope of graph line 600, reflects the fact that more vapor is recovered for a given amount of fuel dispensed when compared to the initial setting of the high flow adjustment screw 562.

However, the reduced slope and increased slope of graph lines 610 and 620, respectively, as compared to the slope of the graph line 600 of the initial setting, reflect the fact that as the rate at which fuel is being dispensed decreases, the high flow adjustment mechanism 560 becomes less efficient with regard to adjusting the amount of vapor recovered relative to the amount of fuel being dispensed. More specifically, for the preferred embodiment discussed, a vapor flow adjustment of 10 liters per minute at a fuel dispensing rate of 40 liters per minute results in a corresponding change of approximately 1 liter per minute vapor flow at the reduced fuel flow rate of 20 liters per minute. The low flow adjustment mechanism 580 facilitates the adjustment of recovered vapor amounts across the full spectrum of fuel dispensing rates.

Referring additionally to FIG. 9B, the use of the low flow adjustment mechanism 580 is discussed. The low flow adjustment mechanism 580 can be used alone or in combination with the high flow adjustment mechanism 560. FIG. 9B includes graph lines 600, 610 and 620 that were previously discussed with regard to FIG. 9A, but are repeated here to facilitate the discussion of how the low flow adjustment mechanism 580 can be used to adjust the amount of vapor recovered. As previously noted, for the exemplary embodiment shown, graph line 600 shows an initial setting for the high flow adjustment mechanism 560 and the low flow adjustment mechanism 580 in which the desired A/L ratio of 1:1 is achieved across a substantial portion of the operating range of the A/L regulator valve 500.

One method of varying the A/L ratios for the A/L regulator valve 500 is reflected in graph lines 602 and 612 of FIG. 9B. Graph line 602 reflects the results of withdrawing the low flow adjustment screw 582 farther from the vapor flow bypass 590 than in its initial setting, thereby reducing the restriction to the flow of vapor through the vapor flow bypass 590. Note, however, the slope of graph line 602 is substantially the same as that of graph line 600. The substantially similar slopes of graph lines 600 and 602 reflect the fact that the increased amount of vapor recovered is substantially the same across the full range of rates at which fuel can be dispensed.

Similarly, the amount of vapor that is recovered for a given amount of dispensed fuel can be reduced by extending the low flow adjustment screw 582 farther into the vapor flow bypass 590 than in its initial setting, thereby further restricting the flow of vapor through the vapor flow bypass 590. Note, the "starting point" for the adjustment of the low flow adjustment screw 582 represented by graph line 612 is graph line 610, meaning prior to adjusting the low flow adjustment screw 582, the high flow adjustment screw 562 had been previously adjusted from the initial setting as discussed with regard to FIG. 8A. The similar slopes of graph lines 610 and 612 reflect the fact that less vapor is recovered across substantially the full range of rates at which fuel is dispensed. Graph lines 602 and 612 show the results of adjusting only the low flow adjustment screw 582 after the desired slope of the graph line has been achieved using the high flow adjustment screw 562.

Referring now to graph line 622 of FIG. 9B, simultaneous adjustment of both the high flow adjustment mechanism 560 and the low flow adjustment mechanism 580 is discussed. Graph line 622 is achieved when starting from graph line 600 which shows the initial setting of an A/L ratio of 1:1 by adjusting both the high flow adjustment screw 562 and the low flow adjustment screw 582. For example, extending the high flow adjustment screw 562 farther into the vapor flow path 552 restricts the flow of vapor through the vapor flow path 552, thereby reducing the slope of graph line 622 as compared to the slope of graph line 600. Next, the low flow adjustment screw 582 is withdrawn farther from the vapor flow bypass 590 than in its initial setting. This results in an increased amount of vapor being recovered across the full spectrum of rates at which fuel is dispensed, in effect, causing the entire graph line 622 to move upwardly while maintaining the substantially same slope that was achieved by adjusting the high flow adjusting screw 562. The net result for the present example is that a greater amount of vapor flow is recovered at reduced fuel dispensing rates, such as 15 liters per minute, whereas a lesser amount of vapor is recovered at increased fuel dispensing rates, such as 35 liters per minute, when compared to the graph line 600 of the initial setting. As such, combined usage of the high flow adjustment mechanism 560 and the low flow adjustment mechanism 580 can achieve numerous A/L ratios across the entire operating range of the associated fuel dispensing unit.

Although the embodiment of the A/L regulator valve 500 shown in FIGS. 8A and 8B includes a vapor flow bypass 590 with a low flow adjustment screw 582 to adjust flow therethrough, other embodiments of the A/L regulator valve 500 that are encompassed by the current invention can use alternate arrangements to effect similar results. For example, varying the amount of vapor recovered for a given amount of fuel dispensed can be achieved by altering the metering nose position relative to the vapor piston body, adjusting the position of the vapor flow orifice axially within the vapor flow path of the housing with a mechanism such as a worm drive, varying the spring force that biases the liquid piston into the closed position, altering the position of the magnet on the liquid piston, and varying the size of the vapor flow orifice by use of a collet-type device.

Figure 4:
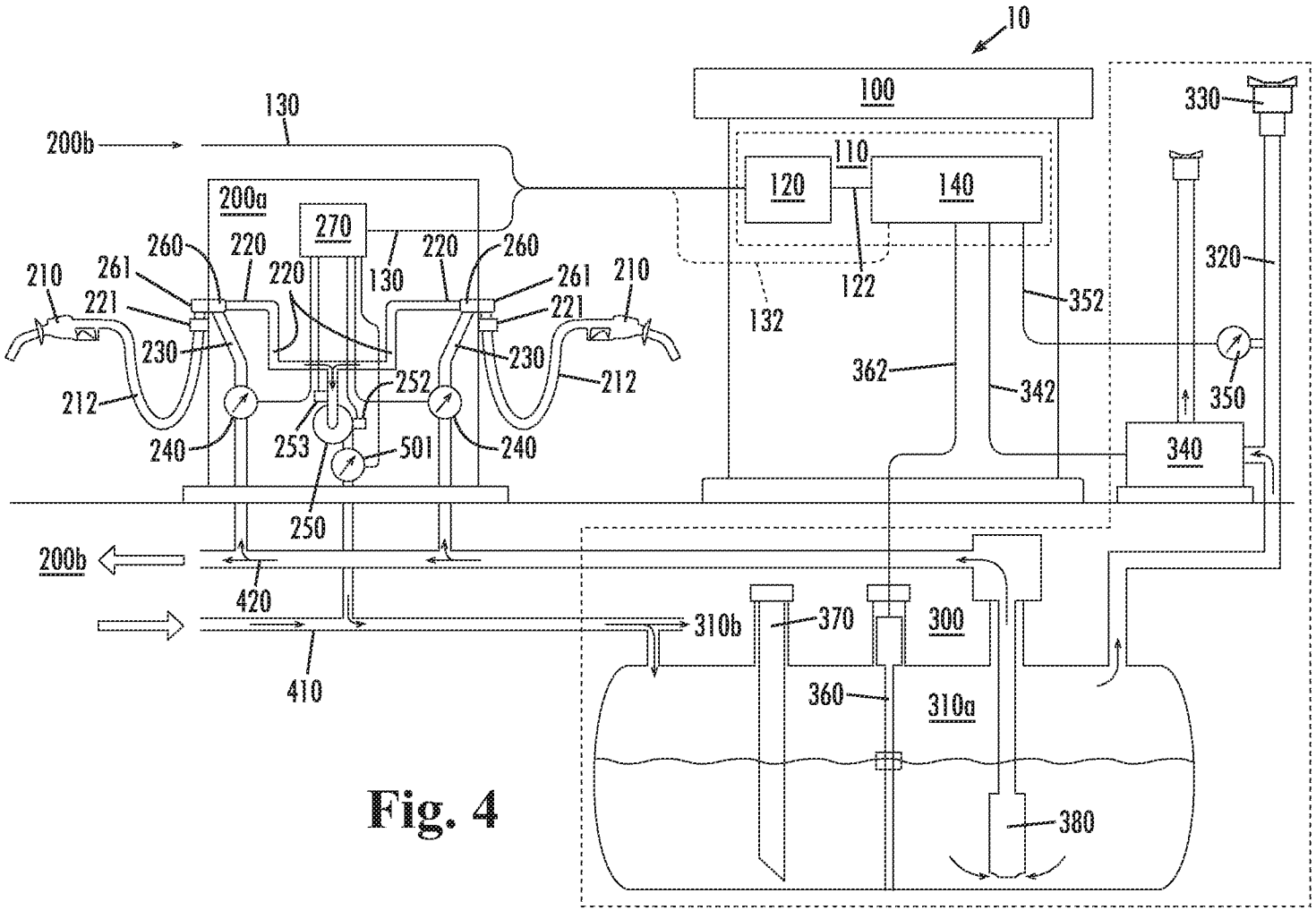
FIG. 4 is a diagrammatic representation of a liquid fuel dispensing facility including a fuel vapor recovery system in accordance with an alternate embodiment of the present invention.
Figure 5:
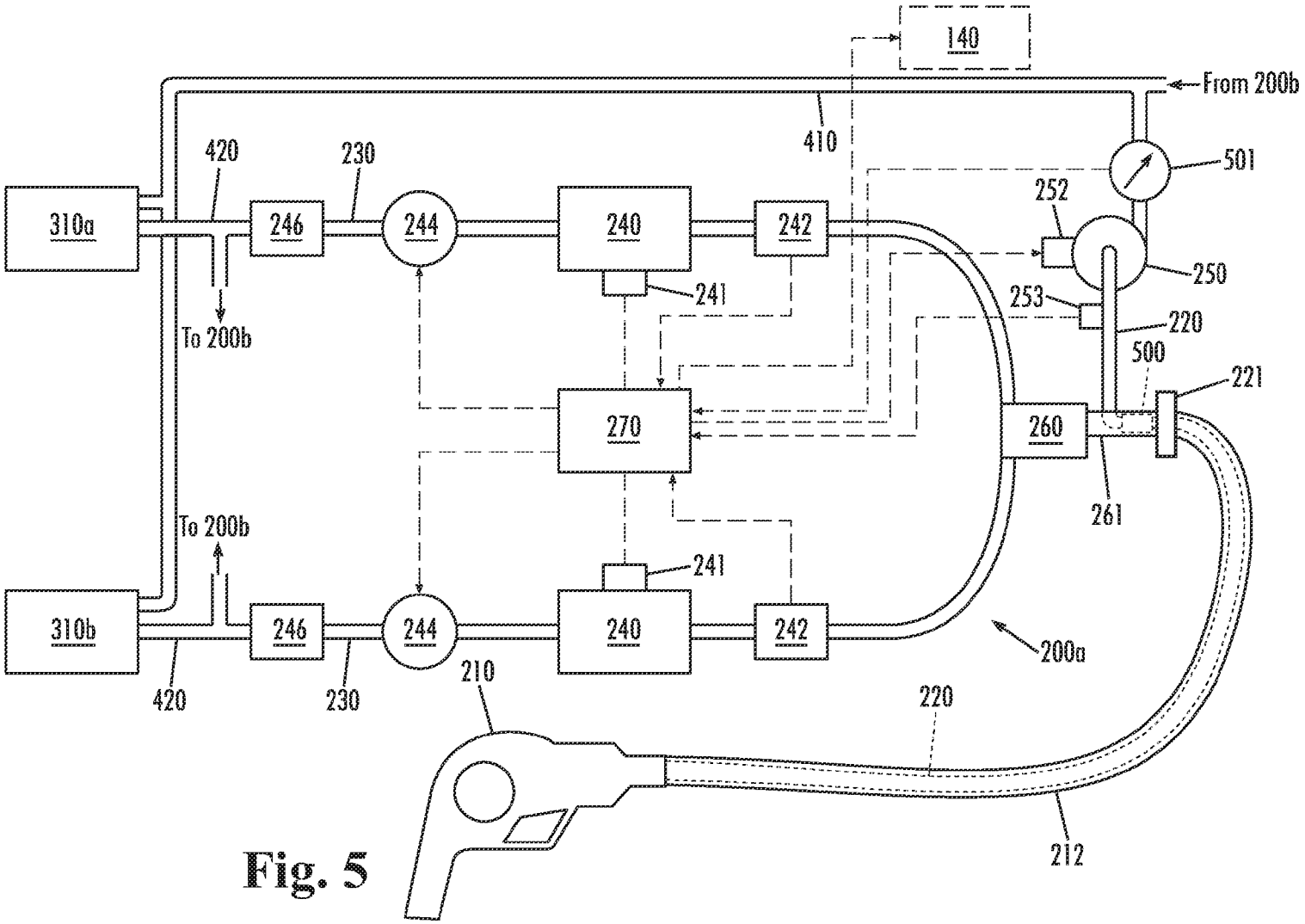
FIG. 5 is a schematic diagram illustrating certain operational characteristics of the fuel dispenser unit as shown in FIG. 4.

A second embodiment of the present invention is shown in FIGS. 4 and 5. The second embodiment differs primarily from the first embodiment in that each fuel dispenser unit 200*a* and 200*b* includes a dedicated vapor pump 250 for the recovery of fuel vapors rather than a single vapor pump 250 that is disposed in the common vapor return pipeline 410 and services multiple fuel dispenser units. As shown, the inlet side of vapor pump 250 is common to both vapor return passages 220 of fuel dispenser unit 200*a* and the outlet side exhausts to the common vapor return pipeline 410. As such, it is the vacuum levels of the vapor return passages 220 within each fuel dispenser unit 200*a* and 200*b* that are monitored rather than the vacuum level within the vapor return pipeline 410. Therefore, pressure sensor 253 is positioned on the inlet side of the vapor pump 250 rather than on the vapor return pipeline 410. An additional difference of the second embodiment is that the control system 270 of each fuel dispenser unit 200*a* and 200*b* controls the operation of its dedicated vapor pump 250 rather than the central data acquisition system 140.

Figure 6:
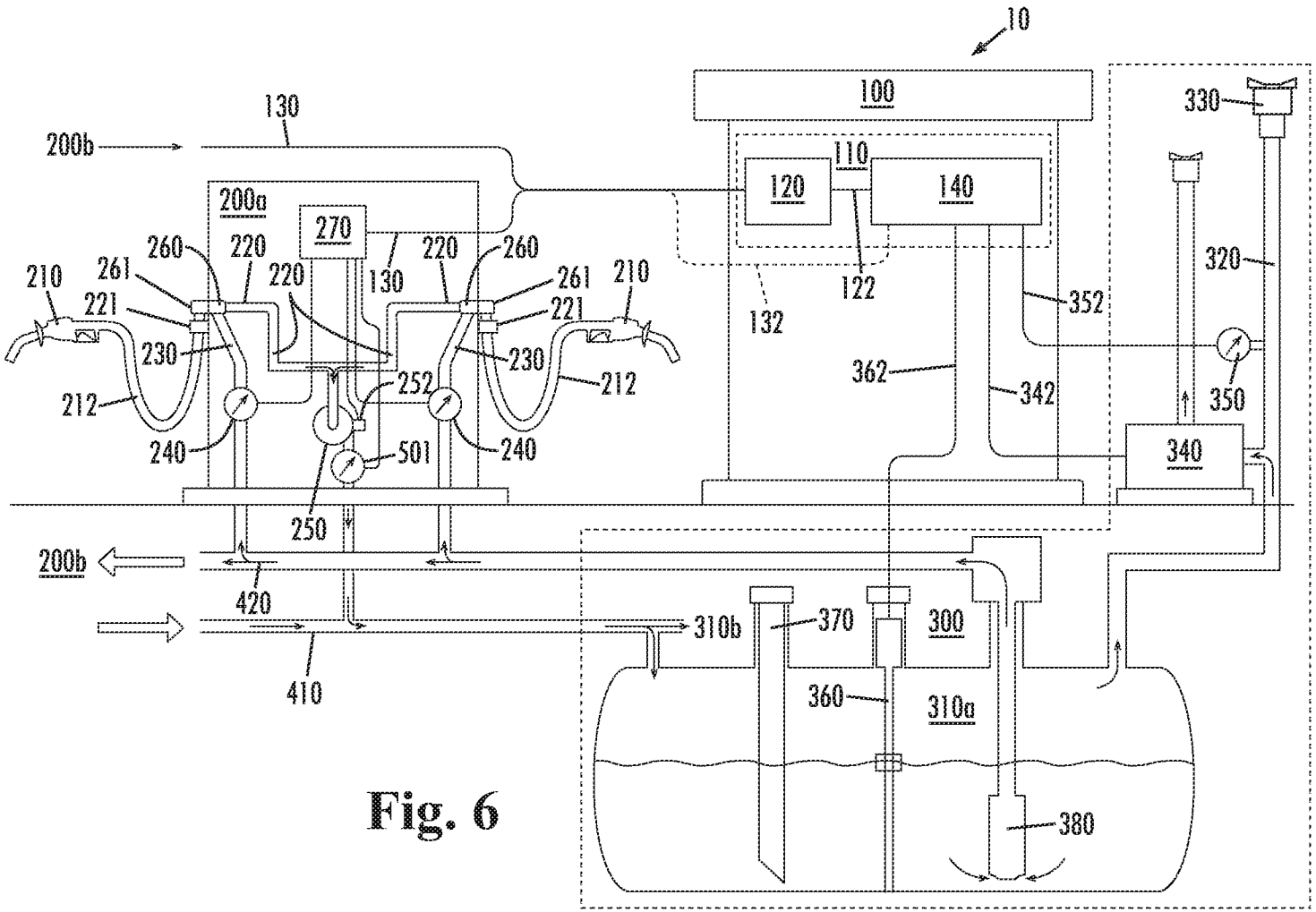
FIG. 6 is a diagrammatic representation of a liquid fuel dispensing facility including a fuel vapor recovery system in accordance with an alternate embodiment of the present invention.

A third embodiment of the present invention is shown in FIG. 6. The third embodiment is similar to the second embodiment in that each fuel dispenser unit 200*a* and 200*b* includes a dedicated vapor pump 250 for the recovery of fuel vapors. As shown, the inlet side of vapor pump 250 is common to both vapor return passages 220 of fuel dispenser unit 200*a* and the outlet side exhausts to the common vapor return pipeline 410. As such, it is the vacuum levels of the vapor return passages 220 within each fuel dispenser unit 200*a* and 200*b* that are monitored rather than the vacuum level within the vapor return pipeline 410. Similarly to the second embodiment of the present invention, in the present embodiment the control system 270 of each fuel dispenser unit 200*a* and 200*b* controls the operation of its dedicated vapor pump 250.

An alternate embodiment of the present invention differs from the first three embodiments in that each fuel dispenser unit 200*a* and 200*b* includes a pair of dedicated vapor pumps 250 for the recovery of fuel vapors rather than a vapor pump 250 that is disposed in the common vapor return pipeline 410, as shown in FIG. 1, or a common vapor return passage 220, as shown in FIGS. 4 and 6, such that the pump services multiple fuel dispensing points. In this embodiment, the inlet side of each vapor pump 250 is a vapor return passage 220 of a single fuel nozzle 210 and the outlet side of each vapor pump 250 exhausts to a common portion of the vapor return passages 220. As such, it is the vacuum level of the individual vapor return passages 220 within each fuel dispenser unit 200*a* and 200*b* that is monitored, rather than the vacuum level within the common vapor return pipeline 410 or a vapor return passage 220 that is common to more than one fuel nozzle 210.

Each of the previously discussed embodiments disclose a vapor recovery system including one or more variable speed vapor pumps. Note, however, that in each of the previously discussed embodiments, the variable speed vapor pumps can be replaced with fixed speed pumps. Additionally, electronic proportional valves (not shown) can be disposed on the upstream side of the various fixed speed pumps.

As discussed above, the control system 270 receives information from liquid fuel dispensing meter 240 and the pulser 241 regarding the amount of fuel being dispensed. The liquid fuel dispensing meter 240 measures the fuel being dispensed while the pulser 241 generates a pulse per count of liquid fuel dispensing meter 240. In an exemplary embodiment, the pulser 241 generates one thousand and twenty-four (1024) pulses per gallon of fuel dispensed. In yet another alternate embodiment of the present invention, the control system 270 provides fuel flow information to the data acquisition system 140 by way of the interface wiring 130. In this embodiment, the rate at which vapor pump 250 is used to recover vapor is determined by the amount of fuel the data acquisition system 140 determines is being dispensed, based on the information provided by the liquid fuel dispensing meters 240 via interface wiring 130. The vapor pump 250 may be a variable speed pump or a constant speed pump with an electronic proportional valve, a mechanical pressure regulator operating across its inlet and outlet, etc., as previously discussed.

While preferred embodiments of the invention have been shown and described, modifications and variations thereto may be practiced by those of ordinary skill in the art without departing from the spirit and scope of the present invention, which is more particularly set forth in the appended claims. In addition, it should be understood the aspects of the various embodiments may be interchanged without departing from the scope of the present invention. Furthermore, those of ordinary skill in the art will appreciate that the foregoing description is by way of example only, and is not intended to limit the invention as further described in such appended claims.

What is claimed is:

1. An air to liquid regulator valve for use with a vapor recovery system that recovers vapors expelled from a vehicle receiving fuel through a fuel supply passage and returns the vapors to an underground storage tank through a vapor return passage in a service station environment, comprising:

a housing defining a fuel flow path in fluid communication with the fuel supply passage and a vapor return path in fluid communication with the vapor return passage;

a vapor return orifice defined by the housing and disposed between a first portion and a second portion of the vapor return path so that vapor flow occurs through the vapor return orifice whenever fuel is dispensed through the fuel supply passage;

a vapor piston including a metering element, the metering element being insertable into the vapor return orifice to regulate the flow of vapors therethrough, and the metering element being configured to prevent the flow of vapors through the vapor return orifice when the metering element is fully seated in the vapor return orifice; and a vapor flow bypass in fluid communication with the first portion and the second portion of the vapor return path such that the flow of vapors through both the vapor flow bypass and the vapor return orifice is possible.

2. The air to liquid regulator valve of claim 1, further comprising a first flow adjustment mechanism that selectively adjusts the vapor flow bypass such that an amount of vapor that is allowed to bypass the vapor return orifice during a fueling operation is adjustable.

3. The air to liquid regulator valve of claim 2, the first flow adjustment mechanism further comprising a first flow adjustment screw disposed within a first bore defined by the housing, wherein first flow adjustment screw is configured to prevent the flow of vapors through the vapor flow bypass when the first flow adjustment screw is fully seated within the vapor flow bypass.

4. The air to liquid regulator valve of claim 2, further comprising a second flow adjustment mechanism that selectively adjusts the vapor flow path such that an amount of vapor that passes therethrough for a given amount of fuel that is dispensed is adjustable.

5. The air to liquid regulator valve of claim 4, the second flow adjustment mechanism further comprising a second flow adjustment screw that is disposed in a second bore defined by the housing.

6. The air to liquid regulator valve of claim 2, further comprising a liquid piston that is slidably disposed within the housing and configured to be fully seated within the fuel flow path, thereby closing the fuel flow path.

7. The air to liquid regulator valve of claim 6, wherein the vapor piston includes a first magnet and the liquid piston includes a second magnet, and interaction between the first and the second magnets causes the vapor piston and the liquid piston to slidably move within the vapor return path and the fuel flow path, respectively, in unison.

8. A vapor recovery system that recovers vapors expelled from a vehicle during refueling at a fuel dispensing point and returns the vapors to an underground storage tank in a service station environment, comprising:

an air to liquid regulator valve associated with the fuel dispensing point, comprising:

a housing defining vapor return path;

a vapor return orifice defined by the housing and disposed between a first portion and a second portion of the vapor return path so that vapor flow occurs through the vapor return orifice whenever fuel is dispensed through the fuel supply passage;

a vapor piston including a metering element, the metering element being insertable into the vapor return orifice to regulate the flow of vapors therethrough, and the metering element being configured to prevent the flow of vapors through the vapor return orifice when the metering element is fully seated in the vapor return orifice; and a vapor flow bypass in fluid communication with the first portion and the second portion of the vapor return path such that the flow of vapors through both the vapor flow bypass and the vapor return orifice is possible, a vapor pump that is in fluid communication with the underground storage tank; and a vapor flow passage that is in fluid communication with the vapor flow path of the air to liquid regulator valve and the vapor pump.

9. The vapor recovery system of claim 8, wherein the air to liquid regulator valve is configured to regulate an amount of vapor that is recovered through the fuel dispensing point for a given amount of fuel that is dispensed through the fuel dispensing point.

10. The vapor recovery system of claim 8, wherein the air to liquid regulator valve further comprises a first flow adjustment mechanism that selectively adjusts the vapor flow bypass such that an amount of vapor that is allowed to bypass the vapor return orifice during a fueling operation is adjustable.

11. The vapor recovery system of claim 10, the first flow adjustment mechanism further comprising a first flow adjustment screw disposed within a first bore defined by the housing, wherein first flow adjustment screw is configured to prevent the flow of vapors through the vapor flow bypass when the first flow adjustment screw is fully seated within the vapor flow bypass.

12. The vapor recovery system of claim 10, the air to liquid regulator valve further comprising a second flow adjustment mechanism that selectively adjusts the vapor flow path such that an amount of vapor that passes therethrough for a given amount of fuel that is dispensed is adjustable.

13. The vapor recovery system of claim 12, the second flow adjustment mechanism further comprising a second flow adjustment screw that is disposed in a second bore defined by the housing.

14. The vapor recovery system of claim 8, further comprising an electronic proportional valve that is disposed in the vapor flow passage between the vapor pump and the air to liquid regulator valve.

15. An air to liquid regulator valve for use with a vapor recovery system that recovers vapors expelled from a vehicle receiving fuel through a fuel supply passage and returns the vapors to an underground storage tank through a vapor return passage in a service station environment, comprising:

a housing defining a fuel flow path in fluid communication with the fuel supply passage and a vapor return path in fluid communication with the vapor return passage;

a vapor return orifice defined by the housing and disposed between a first portion and a second portion of the vapor return path;

a vapor piston including a metering element, wherein the metering element is insertable into the vapor return orifice to regulate the flow of vapors therethrough, and the metering element is configured to prevent the flow of vapors through the vapor return orifice when the metering element is fully seated in the vapor return orifice;

a vapor flow bypass in fluid communication with the first portion and the second portion of the vapor return path such that the flow of vapors through the vapor flow bypass is possible when the metering element prevents the flow of vapors through the vapor return orifice; and a first flow adjustment mechanism that selectively adjusts the vapor flow bypass such that an amount of vapor that is allowed to bypass the vapor return orifice during a fueling operation is adjustable.

16. The air to liquid regulator valve of claim 15, further comprising a second flow adjustment mechanism that selectively adjusts the vapor flow path such that an amount of vapor that passes therethrough for a given amount of fuel that is dispensed is adjustable.

* * * * *